US010589907B2

(12) United States Patent
Lusareta

(10) Patent No.: US 10,589,907 B2
(45) Date of Patent: Mar. 17, 2020

(54) DISPOSABLE LID HAVING SPOUT WITH FILTER FOR BEVERAGE CONTAINER

(75) Inventor: Donald W. Lusareta, Lee's Summit, MO (US)

(73) Assignee: Volo Brands LLC, Altamonte Springs, FL (US)

( * ) Notice: Subject to any disclaimer, the term of this patent is extended or adjusted under 35 U.S.C. 154(b) by 902 days.

(21) Appl. No.: 11/811,041

(22) Filed: Jun. 8, 2007

(65) Prior Publication Data

US 2008/0035652 A1 Feb. 14, 2008

Related U.S. Application Data

(63) Continuation-in-part of application No. 11/403,073, filed on Apr. 12, 2006, now abandoned.

(51) Int. Cl.
*B65D 47/06* (2006.01)
*B65D 47/40* (2006.01)
(Continued)

(52) U.S. Cl.
CPC ..... *B65D 47/06* (2013.01); *B65D 85/812* (2013.01); *B65D 2543/00046* (2013.01)

(58) Field of Classification Search
CPC ..... B65D 2543/00046; B65D 2543/00092; B65D 2543/00296; B65D 2543/00537; B65D 2543/00796; B65D 47/06; B65D 2543/00685; B65D 2543/00731; B65D 2543/00527; B65D 43/0212; B65D 2543/00351; B65D 2543/00509; B65D 47/0847; B65D 85/812; B65D 2543/00555; A47G 19/2272
USPC ..... 220/254.1, 254.3, 367.1, 368–374, 220/704–719, 730, 731, 780; 222/189.06–189.11, 570; 210/232, 266, 210/282, 474; 215/11.1, 11.4, 387–389; 229/404, 906.1; 426/77, 80; 99/323; D7/396.3, 510, 667, 900; D9/435, 447, D9/454
See application file for complete search history.

(56) References Cited

U.S. PATENT DOCUMENTS 110,148 A 12/1870 Leach
302,484 A * 7/1884 Haslage ..... 220/568
(Continued)

FOREIGN PATENT DOCUMENTS

WO WO 2002013666 A1 2/2002
WO WO 2003042058 A2 5/2003

OTHER PUBLICATIONS

International Preliminary Report of Patentability, dated Dec. 11, 2009, 5 pages, International Bureau of WIPO, Geneva, Switzerland.
(Continued)

*Primary Examiner* — Anthony D Stashick
*Assistant Examiner* — Blaine G Neway
(74) *Attorney, Agent, or Firm* — Leydig, Voit & Mayer, Ltd.

(57) ABSTRACT

A disposable lid for a drink container has an annular cover portion with a spout having an opening therethrough. A container attachment portion of the lid provides removable association with the rim of the drink container. A liquid permeable filter is positioned within the spout. The liquid permeable filter is positioned to intercept all liquid flowing from the container through the opening.

24 Claims, 7 Drawing Sheets

(51) Int. Cl.
*B65D 85/812* (2006.01)
*A47G 19/22* (2006.01)

(56) References Cited

U.S. PATENT DOCUMENTS 442,698 A 12/1890 Yates
596,369 A * 12/1897 Jackson ..... 222/189.07
1,224,009 A * 4/1917 Niemann ..... 210/306
1,546,230 A * 7/1925 Grover et al. ..... 210/300
1,637,656 A * 8/1927 Radcliffe ..... 312/31.1
2,011,122 A * 8/1935 Shields ..... 222/189.07
2,215,607 A * 9/1940 Eastwood ..... 210/465
2,357,063 A * 8/1944 Swing ..... 210/469
2,370,668 A * 3/1945 Johnson ..... 222/189.07
2,556,627 A * 6/1951 Miksis ..... 222/568
2,606,694 A * 8/1952 Galletta ..... 222/189.07
2,744,631 A * 5/1956 Toombs ..... 210/469
2,885,084 A * 5/1959 Rocca ..... 210/464
2,940,447 A * 6/1960 Zanegood ..... 604/78
3,302,644 A * 2/1967 Kennedy et al. ..... 604/78
3,360,161 A 12/1967 Smith
3,601,140 A * 8/1971 Hooper ..... F16T 1/12 137/107
3,810,470 A * 5/1974 Von Gunten ..... 604/78
3,940,012 A * 2/1976 Addington ..... 220/719
3,951,798 A * 4/1976 Haldopoulos ..... 210/452
3,977,560 A * 8/1976 Stumpf et al. ..... 220/265
D254,482 S * 3/1980 Bell ..... D9/435
4,235,344 A * 11/1980 Kulle et al. ..... 215/250
4,240,568 A * 12/1980 Pool ..... 222/189.07
4,243,156 A * 1/1981 Lobbestael ..... 222/541.6
D259,231 S * 5/1981 Kozlow, Sr. ..... D7/392.1
4,331,255 A 5/1982 Fournier
4,366,914 A * 1/1983 Ingram ..... 220/287
4,478,346 A * 10/1984 Spong ..... 220/711
4,768,674 A * 9/1988 Prescott ..... 220/719
4,828,141 A * 5/1989 Coy ..... 220/380
4,842,157 A * 6/1989 Stone-Parker et al. ..... 220/719
4,899,902 A * 2/1990 DeMars ..... B65D 43/0212 220/254.3
4,934,545 A * 6/1990 Pezzoli et al. ..... 215/250
4,938,375 A 7/1990 Fantacone
4,938,379 A 7/1990 Kellner
4,961,510 A * 10/1990 Dvoracek ..... 220/713
4,999,109 A * 3/1991 Sabre ..... 210/244
5,035,800 A 7/1991 Kopach
5,094,543 A * 3/1992 Mursa ..... 366/247
5,125,522 A * 6/1992 Pezzoli et al. ..... 215/250
5,125,525 A 6/1992 Tucker
5,146,870 A * 9/1992 Eyas ..... 119/260
D330,332 S * 10/1992 Pezzoli et al. ..... D9/435
5,168,140 A * 12/1992 Welker ..... 219/689
5,186,347 A * 2/1993 Freeman et al. ..... 220/254.1
5,203,467 A 4/1993 Tucker
5,318,703 A * 6/1994 Heiligman ..... 210/264
5,363,983 A * 11/1994 Proshan ..... 220/717
5,379,914 A 1/1995 Martins
5,395,006 A * 3/1995 Verma ..... 220/371
5,411,661 A * 5/1995 Heiligman ..... 210/264
5,424,083 A * 6/1995 Lozito ..... 426/82
5,433,338 A * 7/1995 Proshan ..... 220/717
5,474,674 A * 12/1995 Bresolin et al. ..... 210/167.21
5,538,156 A * 7/1996 Proshan ..... 220/717
5,540,350 A 7/1996 Lansky
5,542,670 A * 8/1996 Morano ..... 220/714
5,720,412 A * 2/1998 Ficken ..... 220/703
5,727,712 A * 3/1998 Costello ..... 220/703
5,775,205 A * 7/1998 Melton ..... 99/322
5,775,534 A 7/1998 Webb et al.
D400,397 S * 11/1998 Stephan ..... D7/510
D401,151 S * 11/1998 Rogge et al. ..... D9/454
5,846,418 A * 12/1998 Thompson ..... A47J 31/605 210/266
5,860,558 A 1/1999 Fahy
5,890,621 A * 4/1999 Bachman et al. ..... 220/717
5,913,964 A * 6/1999 Melton ..... 99/322
5,971,202 A * 10/1999 Filbrun ..... 220/719
5,979,689 A 11/1999 Lansky
5,988,426 A * 11/1999 Stern ..... 220/371
6,076,450 A * 6/2000 DiGiorgio, Jr. ..... 99/298
6,095,033 A * 8/2000 Melton ..... 99/323.3
6,095,356 A * 8/2000 Rits ..... 215/261
6,126,048 A * 10/2000 Bublitz ..... 222/570
6,199,711 B1 3/2001 Lansky
6,263,781 B1 7/2001 Calagui
6,314,866 B1 * 11/2001 Melton ..... 99/322
6,374,726 B1 4/2002 Melton
6,460,725 B1 * 10/2002 Portman et al. ..... 220/713
6,464,099 B1 * 10/2002 Portman et al. ..... 220/712
6,578,726 B1 * 6/2003 Schaefer ..... 220/253
6,607,762 B2 8/2003 Lazaris et al.
6,609,630 B1 * 8/2003 Freeman et al. ..... 220/714
6,619,499 B1 * 9/2003 Lin ..... 220/371
6,622,614 B1 * 9/2003 Smith ..... 99/284
6,702,145 B2 3/2004 Malcolm
6,726,946 B1 * 4/2004 Smith ..... 426/431
6,729,494 B2 * 5/2004 Portman et al. ..... 220/713
6,976,604 B2 * 12/2005 Connors et al. ..... 220/713
D513,916 S * 1/2006 Namee ..... D7/300.1
6,981,962 B1 * 1/2006 Lenkersdorf ..... 604/78
7,032,507 B2 * 4/2006 Cai ..... A47J 27/2105 99/317
7,185,784 B2 * 3/2007 Connors et al. ..... 220/713
7,240,809 B2 * 7/2007 Godfrey ..... 222/189.07
7,284,676 B2 * 10/2007 Dantani ..... 220/711
7,431,175 B2 * 10/2008 Heilos ..... 220/717
8,608,017 B2 * 12/2013 Connors et al. ..... 220/713
2002/0038803 A1 * 4/2002 Malcolm ..... 220/713
2002/0158075 A1 * 10/2002 Caldicott et al. ..... 220/714
2003/0066839 A1 * 4/2003 Connors et al. ..... 220/713
2004/0222230 A1 11/2004 Samson et al.
2004/0245258 A1 * 12/2004 Connors et al. ..... 220/713
2005/0072787 A1 4/2005 Morris et al.
2005/0139091 A1 6/2005 Haverstock
2005/0205587 A1 9/2005 Sampson et al.
2005/0224503 A1 10/2005 Dantani
2006/0037963 A1 * 2/2006 Pillado ..... 220/714
2006/0163251 A1 * 7/2006 Kelstrom et al. ..... 220/253
2006/0261064 A1 * 11/2006 Holley, Jr. ..... 220/203.06
2007/0145058 A1 * 6/2007 Connors et al. ..... 220/719
2008/0277372 A1 * 11/2008 Baggio et al. ..... 215/308

OTHER PUBLICATIONS

International Search Report, dated Jun. 1, 2009, 3 pages, International Search Authority, Alexandria, Virginia.
Written Opinion of the International Searching Authority, dated Jun. 1, 2009, 4 pages, International Search Authority, Alexandria, Virginia.
European Search Report, dated Aug. 2, 2007, 2 pages, European Patent Office, Munich, Germany.

* cited by examiner

DISPOSABLE LID HAVING SPOUT WITH FILTER FOR BEVERAGE CONTAINER

This continuation-in-part application claims priority to U.S. patent application Ser. No. 11/403,073 filed Apr. 12, 2006 now abandoned.

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates primarily to the making of tea and dispensing of the tea to a customer at a restaurant or at a take-out service where carry-out drink containers with disposable lids are used or at home where disposable lids are desired.

Recently, there has been a rapid increase of gourmet coffee shops which dispense gourmet coffee, tea and other beverages for on-premises or off-premises consumption in drink containers. The shops have catered to the coffee drinker by providing a wide variety of specialized coffee products including customized blends.

Many consumers in response to a perceived need to reduce their consumption of caffeine, are changing from coffee to tea, particularly herbal teas which are either very low in caffeine or completely caffeine free. However, the confirmed tea drinker generally finds a very limited variety of teas and only in the form of a tea bag, leaving the consumer with less than a gourmet experience.

While the processes of brewing tea and coffee have many similarities, the brewing of tea has traditionally been considered an art and hence, has not been, until the recent concern about caffeine, a part of fast-food or take-out services where drinks are dispensed in containers with disposable lids.

Prior to the creation of the tea bag, tea was brewed by pouring hot water over tea leaves in a pot and steeped until the tea reached desirable strength after which it was poured into a cup and consumed. Screens or strainers were provided to keep the tea leaves from escaping into the cup from which the consumer would drink the tea beverage. While the advent of the tea bag prevented the escape of tea leaves into the tea beverage, there are many disadvantages to the tea bag. For instance, the amount of tea leaves present in the bag is determined exclusively by the tea bag manufacturer. Tea drinkers vary in their desires for strength of the tea and the flavor of the tea. In fact, teas offer a much wider range of essences and flavors than do coffees.

Many tea drinkers are acutely aware of environmental problems and, for such consumers, there is a negative reaction to bleached papers used in tea bags. Furthermore, the use of strings and staples to facilitate the placing of the tea bag in the cup creates problems in the disposition of such products. Elimination of the string and staples requires the server to use tongs to place the tea bag in the cup for sanitation reasons.

The foregoing disadvantages associated with tea bags are exacerbated when the beverage is sold "to go". If the consumer tries to remove the bag because it interferes with the opening through which the tea flows, it may require the consumer to open the lid in order to remove the bag or place the bag in a certain position thus subjecting the consumer to possible injury due to the high temperature of the water.

The foregoing aspects of the prior art practices argue strongly for using brewing methods other than those involving tea bags and conventional container lids. The present invention, in several embodiments described below, avoids or eliminates some of the disadvantages related to use of tea bags and other brewing methods requiring strainers and the like. The present invention also overcomes some of the difficulties and disadvantages faced by lids for beverages, as those lids are conventionally constructed in the prior art. Yet the present invention also can be used with bagged tea or other pre-charged infusions or pre-charged brewed beverages such as coffee bags and the like.

Bulk or "loose" tea is perceived to be of higher quality than bagged tea. Bulk tea requires less space per serving than the bagged tea and has virtually no waste to be disposed of in comparison to the bagged tea which has the envelopes containing the tea bags, the box in which the envelopes are shipped and the bag itself. In order to serve a popular market successfully, the vendor should be able to offer several varieties of black tea, several varieties of green tea and a significant number of herbal teas along with a number of flavoring enhancers or additives. These provide at least 10 or 20 varieties of teas and flavoring products, all of which are available at a lower cost in bulk, "loose" form which can be shipped and stored in much smaller containers. The use of jars or cans or the like, is particularly desirable because they can be resealed thus preserving freshness.

Besides tea, there are other hot beverages which can benefit from the present invention. For example, there are flavored coffees which must be made and served in quantity rather than to the customer's individual taste. Like tea, the coffee can be provided in bulk so that the customer can pick and choose a mixture of flavors to provide his or her customized hot drink.

In the manufacture of the tea bags, the tea leaves tend to become crushed and broken thereby restricting the circulation of the leaves in the hot water. Most tea bag manufacturers tend to use a lower quality of tea leaves. Furthermore, there is the problem of the disposal of the tea bag. Tea bags are generally available in only one or two sizes as are the size of the containers thus limiting the strength of the tea drink provided.

Tea drinkers of today have reached a degree of sophistication where they are desirous of customized blends of tea leaves to provide a particular essence and flavor which is not available in the array of pre-manufactured tea bags. To serve this need, shops may have canisters of many different tea leaves to provide the consumer with the opportunity to experiment with blends until the desired essence and flavor is present. But simply placing the tea leaves in a drink container and adding hot water leaves the tea leaves loose in the bottom of the drink container. Many tea drinkers have a variety of tea leaves at home so as to provide a customized flavor and essence. However, it is not always advantageous to brew tea the old fashioned way.

The present invention provides a disposable lid with filter for a drink container to overcome the problem of loose tea leaves or any other insoluble matter not desirous to consume from reaching the mouth of the drink consumer.

BRIEF SUMMARY OF THE INVENTION

Briefly stated, the present invention provides a disposable lid with filter for a drink container. The lid is comprised of an annular cover portion having an opening through which liquid can be consumed from the drink container. A container attachment portion of the lid is provided for removable association with the rim of the drink container in a snug, liquid-tight relation. A liquid permeable filter is positioned between the container attachment portion and the annular cover portion of the lid. The liquid permeable filter is positioned so as to intercept all liquid flowing from the container through the opening and hence to the mouth of the consumer.

The liquid permeable filter may be comprised of a mesh material, a porous material, a disk with holes and/or slits to permit the flow of liquid there through, and any other suitable filter which will remove undesirable solid substances from the liquid in the container as the liquid flows from the container through the opening in the annular cover portion of the lid.

When utilizing the lid of the present invention, the typical tea consumer merely places the desired tea leaves into the liquid container, adds hot water in the desired amount, allows the tea to steep for an appropriate amount of time, places the lid with filter on the liquid container and consumes the brewed tea beverage at leisure being assured that no tea leaves slip through the opening through which the beverage is consumed.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DETAILED DESCRIPTION OF THE INVENTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
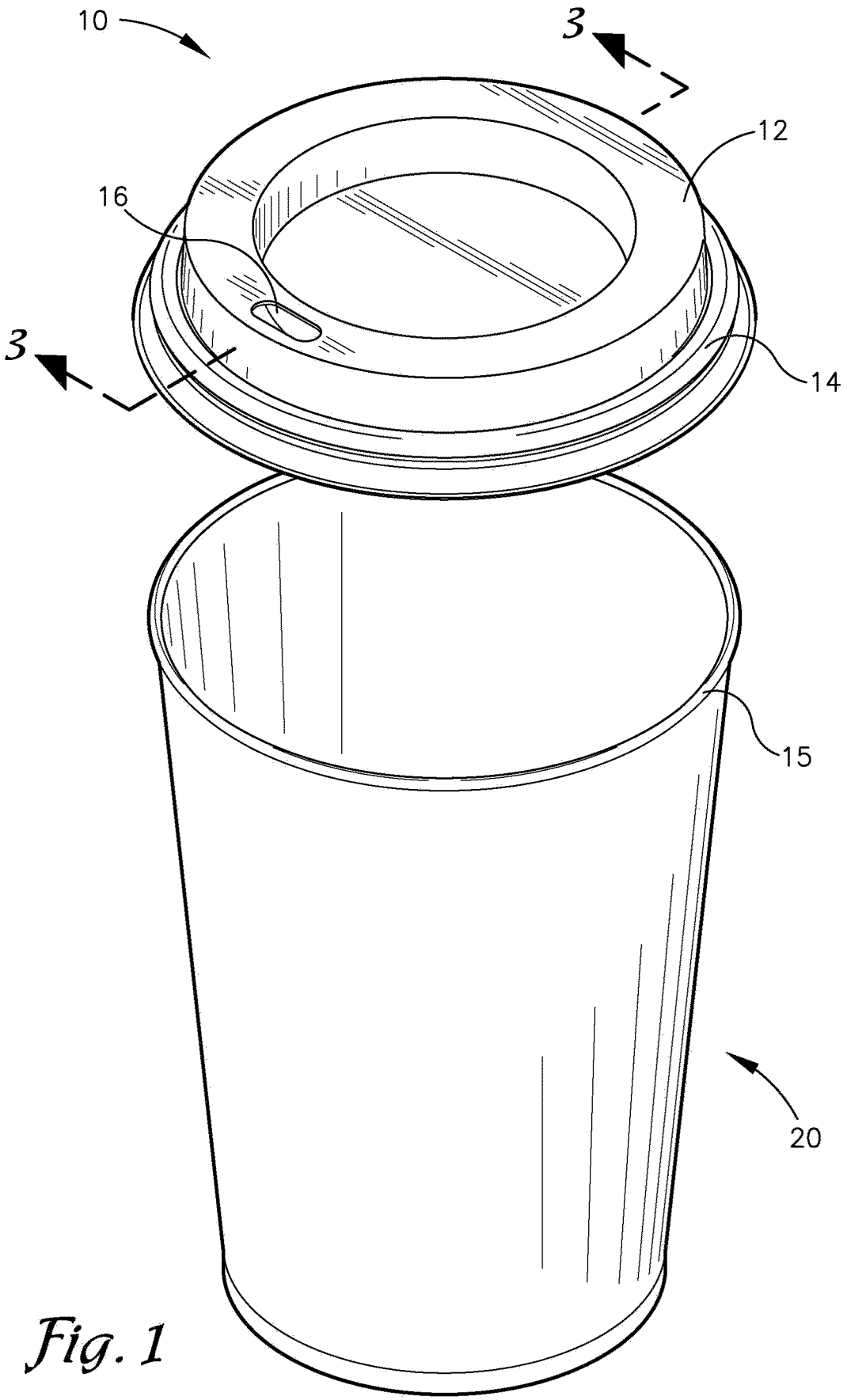
FIG. 1 is a top perspective view of one embodiment of the present invention.

FIG. 1 depicts a typical drink container 20 sold at coffee shops, fast-food restaurants, diners and many other food and drink businesses which sell eat-in or carry-out food and accompanying drink containers as well as a cup or glass from the home kitchen. A disposable lid 10 depicted in FIG. 1 appears to be typical of lids for drink containers. The lid 10 has an annular cover portion 12 which is provided with an opening 16. The opening 16 allows liquid to be consumed from the container 20 in a conventional manner. The lid 10 also has a container attachment portion 14 for removable association with the rim 15 of the container 20 in a snug, liquid-tight relation.

Figure 2:
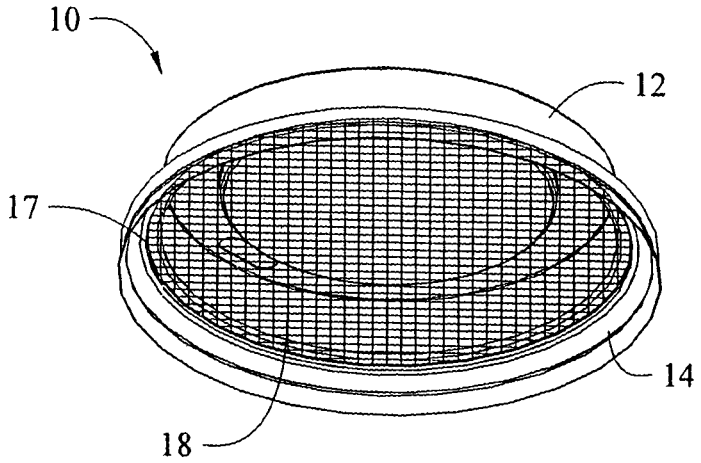
FIG. 2 is a bottom perspective view of the lid of the embodiment of FIG. 1.

FIG. 2 depicts the under side of the lid 10 showing a filter 18 positioned across the area of the interior of the lid 10 so as to intercept any liquid flowing from the container 20 through the opening 16 of the lid 10. It is preferred that the position of the filer 18 within the lid 10 is such that the filter 18 is a sufficient distance from the opening 16 that tea leaves or undesirable solid substances in the liquid container 20 will not jam against the filter 18 in a manner such as to impede the flow of liquid from the container 20 through the opening 16. The filter 18 is attached to the inside 17 of the lid 10 in a suitable manner such as with the use of an adhesive, of heat sealing or any other suitable means of attaching the filter 18 to the inside 17 of the lid 10.

Figure 3:
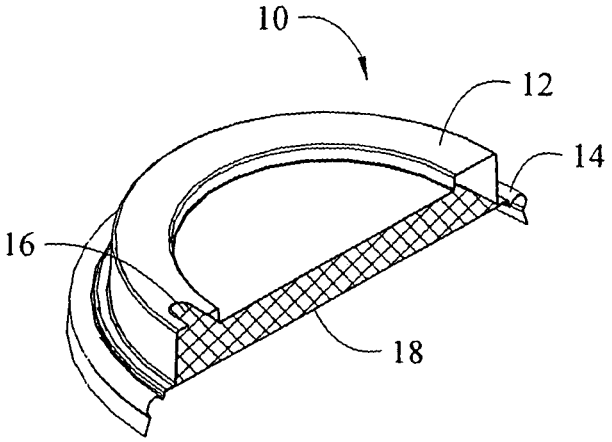
FIG. 3 is a side perspective section view along line 3-3 of FIG. 1.

FIG. 3 depicts a side perspective section view along line 3-3 of FIG. 1. This figure illustrates a suggested positioning of the filter 18 with respect to the container attachment portion 14, the opening 16 and the annular cover portion 12 of the lid 10. In this embodiment, the filter 18 is somewhat taut thus keeping the filter 18 from engaging the opening 16 of the lid 10.

Figure 4:
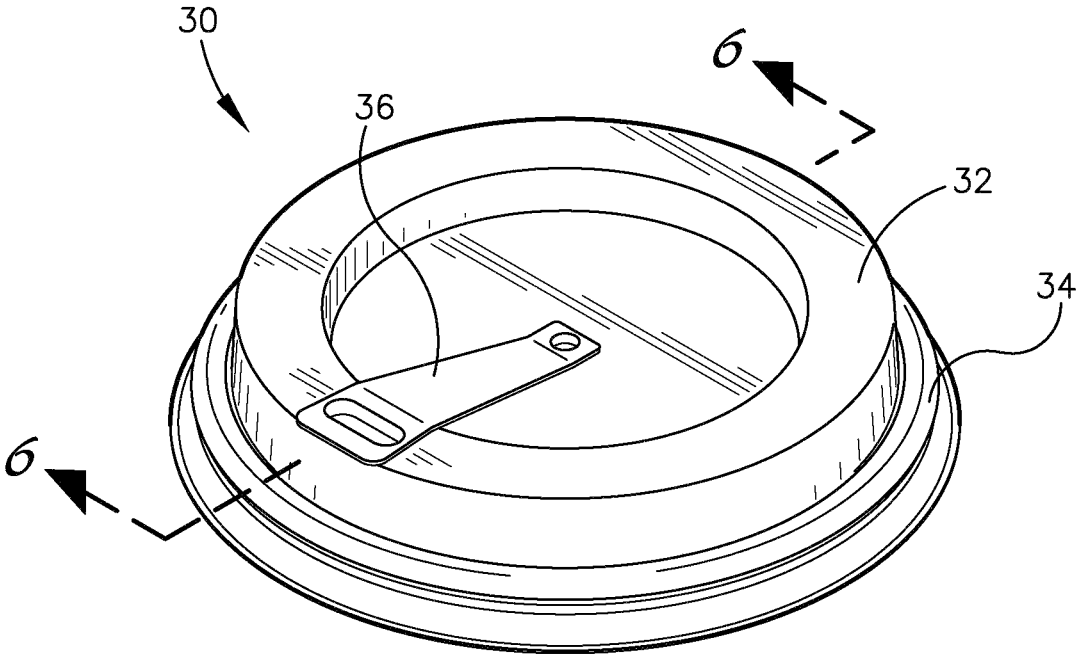
FIG. 4 is a top perspective view of another embodiment of the present invention.

FIG. 4 is a top perspective view of another embodiment of the present invention. The disposable lid 30 has a swivel tab 36 which when lifted provides an opening 35 (see FIG. 4) through which liquid can be consumed from the container 20. The swivel tab 36 swivels about a pivot 37 permitting the opening 35 to be resealed to prevent spillage from the container 20 when the consumer is not drinking from the container 20. The lid 30 has an annular cover portion 32 and a container attachment portion 34 to allow the lid 30 to be separated from the rim 15 of the container 20, if desired.

Figure 5:
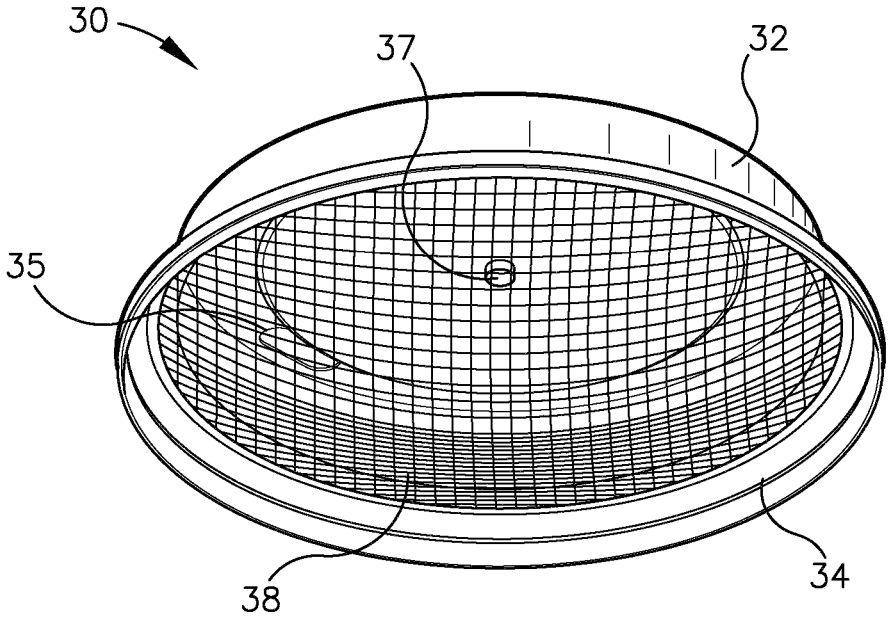
FIG. 5 is a bottom perspective view of the embodiment of FIG. 4.

FIG. 5 depicts a bottom perspective view of the lid 30 of FIG. 4. The filter 38 is a mesh material which rather than being taut is relaxed so as to allow the stacking one on another of a multiplicity of lids 30 for the convenience of storage when shipping and when being used in a shop.

Figure 6:
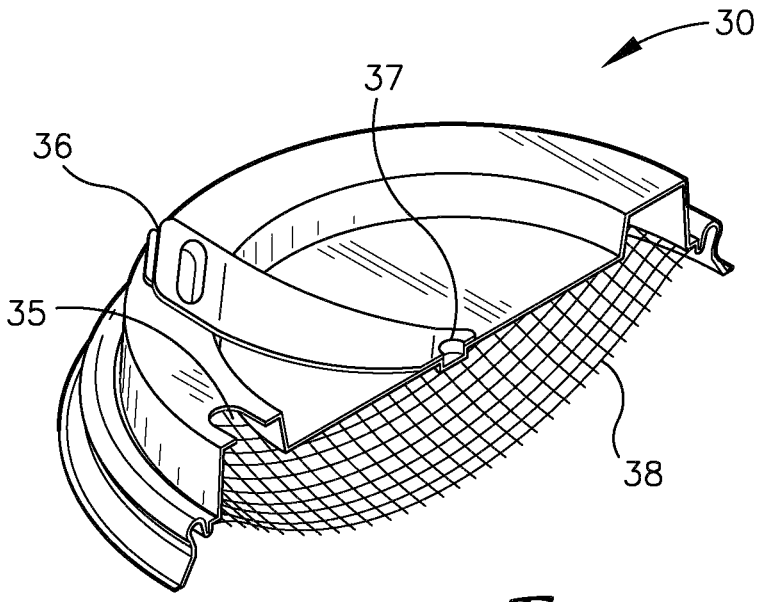
FIG. 6 is a side perspective section view along line 6-6 of FIG. 4

FIG. 6 illustrates a side section view along line 6-6 of FIG. 4 to illustrate the more relaxed filter 38 to allow stacking of the lids for shipping, storage and when in a dispensing bin at a shop. Even though the filter 38 is relaxed, it is preferred that the filter 38 not reach the opening 35 when the drink is being consumed from the container 20 to prevent a jam of tea leaves or other solid material in the drink container 20. The swivel top 36 can be moved around the pivot 37 to allow closure of the lid 30 to prevent spillage when the drink is not being consumed.

Figure 7:
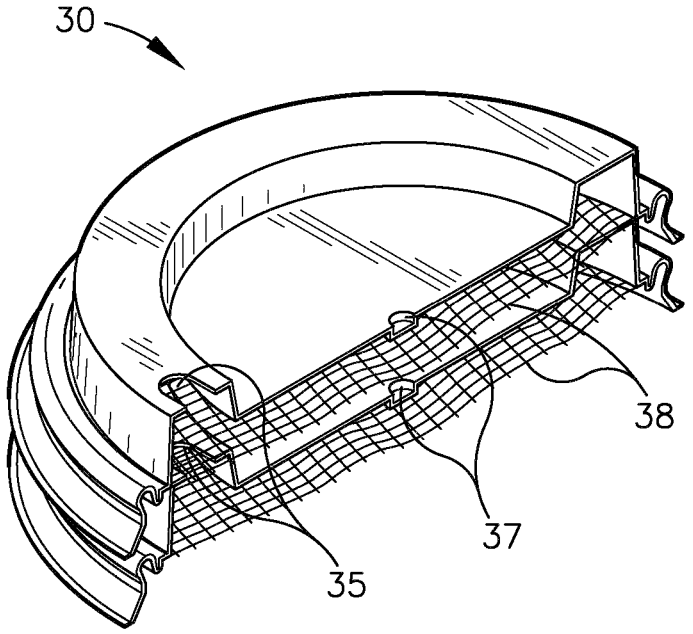
FIG. 7 is a side perspective section view of a multiplicity of the embodiment of FIG. 6.

FIG. 7 is a side section view along line 6-6 of FIG. 4 of two lids 30 in a nesting configuration thereby allowing compaction for the purposes of shipping and storage of the lids 30.

Another embodiment of the disposable cup lid is shown in FIGS. 8-12 wherein a filtering material is provided situated within the spout portion of the cup lid and a holding area for filtered liquid is provided immediately above the filtered material. The benefits of the arrangement between the filtering material and the holding area now will be described.

Figure 9:
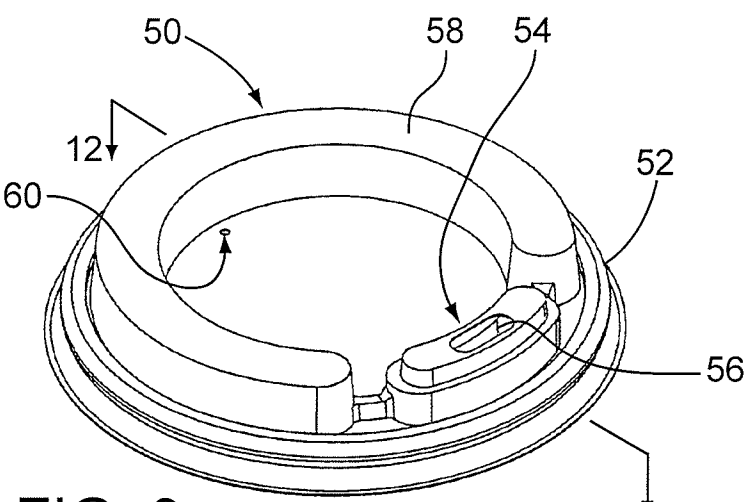
FIG. 9 is a top and side perspective view of an alternate embodiment of the disposable cup lid shown in FIG. 8.

First referring to FIG. 9, disposable lid 50 is shown in perspective view. The disposable lid 50 is provided with a rim area 52 which is used to secure the lid to a typical disposable cup usually formed of either paper or plastic material. It will be appreciated that lid 50, while intended to be disposable, may be reused and may be affixed to reusable cups at the desire of the user. Disposable lid 50 is provided with a spout 54 through which a liquid may pass from the cup having lid 50 attached thereto into the mouth of the user. Spout 54 is provided with void 56 which is the particular means by which fluid escapes spout 54 into the mouth of the user. It will be appreciated by those skilled in the art that disposable lid 50 attaches to a cup 70 (FIG. 12) by the conventional frictional fit method in which rim 52 is press fitted against the rim of the cup to secure lid 50 onto the cup.

Figure 8:
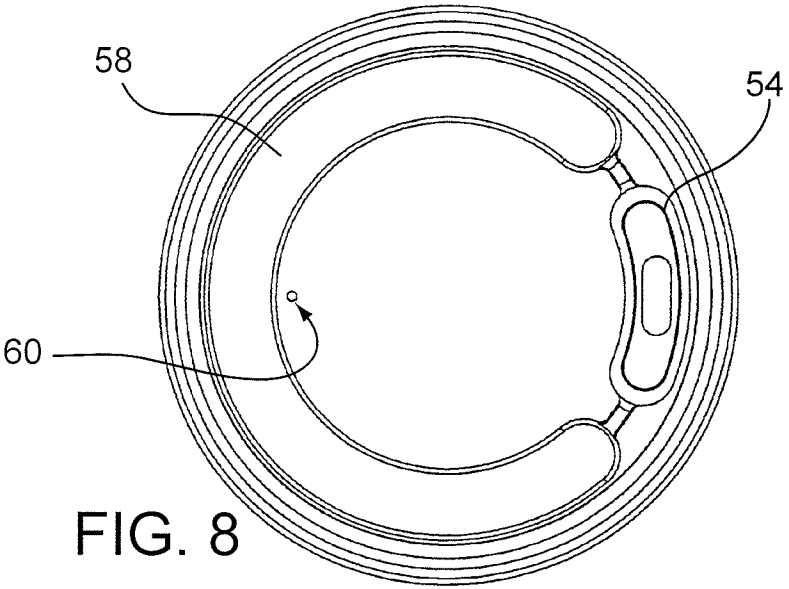
FIG. 8 is a top plan view of an alternate embodiment of the disposable lid.
Figure 11:
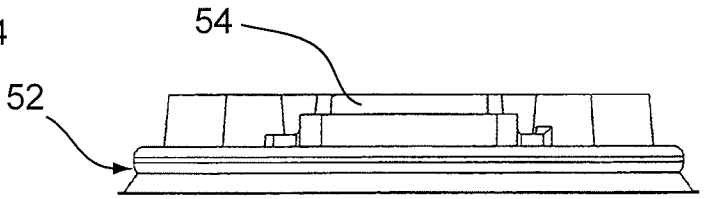
FIG. 11 is a side elevation view of the spout of the disposable cup lid embodiment of FIG. 8.
Figure 10:
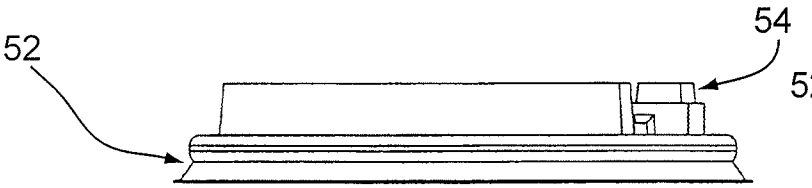
FIG. 10 is a side elevation view of the alternate embodiment of the disposable cup lid shown in FIG. 8.

FIG. 8 provides a plan view of the lid shown in FIG. 9. FIG. 10 and FIG. 11 show side elevation views of the lid shown in FIG. 9. In these figures reference numbers which are similar to those used in FIG. 9 indicate the same or a similar feature. The benefits and advantages of the disposable lid embodiment shown in FIGS. 8-12 will now be more fully described with reference to FIG. 12 in particular.

Figure 12:
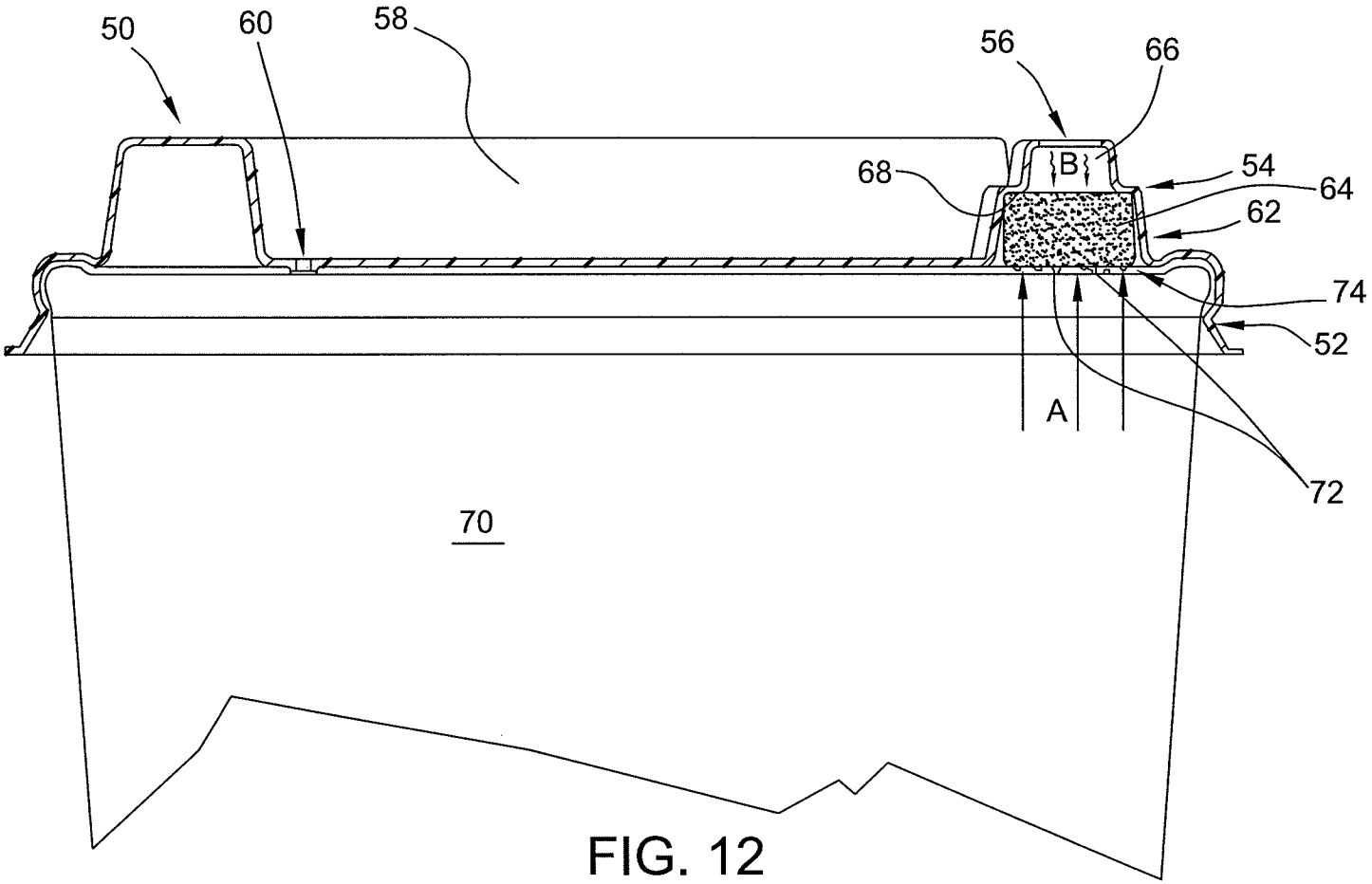
FIG. 12 is a cross section elevation view taken along line 12-12 of FIG. 9 and showing the filter inserted within the spout portion of the lid and the holding area for filtered liquid positioned above the filter and below the spout void.

In FIG. 12, a cross section view of the disposable lid 50 of FIGS. 8-12 is shown. The cross section is taken along line 12-12 of FIG. 9. As may be best seen in FIG. 12, lid 50 is provided with a retainer 58 for restricting any liquid on the top of the rim which may flow from the cup through vent hole 60. Retainer 58 prevents any liquid escaping through vent hole 60 from draining off the top of lid 50. Lid 50 is further provided with spout 54 which, as best seen in FIG. 12, is comprised of a spout filter area 62 having filter 64 situated therein. Positioned above spout filter area 62 is spout fluid-holding portion or spout holding area 66 which serves to temporarily retain a portion of the liquid that has been filtered through filter 64 prior to exiting the lid through void 56 and into the mouth of the user. It will be appreciated by examination of filter 12 that spout holding area is slightly narrower than spout filter area 62, thus providing shoulder 68 which serves to retain filter 64 within spout filter area 62 and prevent filter 64 from encroaching into spout holding area 66 as the lid 50 is manipulated by a user from an upright position into a sidewise position for use and as the liquid beverage passes through filter 64 and into spout holding area 66.

Still referring to FIG. 12, the operational benefits of the structures previously identified will be described. It will be appreciated that in the course of use of disposable lid 50, while the lid is attached to a cup 70 holding a beverage, that lid 50 will be variously disposed in a first, or upright, position in which the longitudinal axis of the cup 70 is generally vertically disposed. Lid 50 may also be displaced in various non-vertical positions as it is moved from a generally vertical position previously described into an angled position to allow a user to sip a beverage through lid 50. It is the movement of lid 50 from the tipped or angled, beverage filtering position back to the upright position which allows the operational effect between filter 64 and the filtered beverage that has passed through filter 64 and into spout holding area 66 of spout 54 to be achieved. This operational effect is the cleaning, or partial cleaning, of filter 64 as the cup lid is repositioned into the vertical or upright position from the tipped or angled, beverage filtering position.

Specifically, filter 64 is provided within lid 50 to allow a user to prepare a beverage in a cup using loose tea (that is tea that is not retained within some other super structure such as a filtering bag) or ground coffee placed directly into the cup before or after the addition of hot water into the cup 70. The use of filtering lid 50 allows these beverages to be made from such loose materials even though these loose material are generally considered undesirable to consume. The filter lid allows the solids of the ground tea leaves or ground coffee to be strained from the brewed beverage as the liquid within the cup contacts filter 64 as the liquid passes from the cup through filter 64 into spout holding area 66 and eventually out of void 56 and spout 54. It will be appreciated that this manner of use allows the filtering of the beverage within the cup.

The additional operation effect of cleaning the filter 64 is accomplished by the inclusion of the spout holding area 66 adjacent to the filter 64. Spout holding area 66 operates to retain an amount of the filtered beverage within the spout 54. Specifically the unfiltered beverage in cup 70 passes through filter 64 in the direction of Arrow "A" (FIG. 12) as the cup is moved into the tilted, or drinking or pouring position. The unfiltered beverage is brought into contact with the filter 64 as a result of the tilting movement of cup 70. The unfiltered beverage becomes a filtered beverage as it passes through filter 64. The filtered beverage then passes into spout holding area 66 prior to passing through void 56 and out of lid 50.

At the conclusion of the tipping of cup 70 and/or the drinking from spout 54, an amount of the filtered beverage is retained within spout holding area 66. This residual filtered beverage then operates to clean or partially clean filter 64 by reversing flow an moving back through filter 64 as the cup 70 is returned to its vertical or upright position. As the residual filtered beverage flows back through filter 64 in the direction indicated by Arrow "B" (FIG. 12) the filtered beverage contact the filtrand or filtered material 72 that is on the bottom surface 74 of filter 64. The return flow or reverse flow of the residual filtered beverage back through filter 64 serves to clean or partially clean filter 64 between sips from cup 70 thereby maintaining generally unobstructed flow of beverage from the cup during use.

The filter used in the embodiment of FIGS. 8-12 is, in a best mode, a filter of approximate ¼ inch (6 mm) thickness composed of a generally open foam-like or open-cellular structure composed of plastic or paper or cellulose-based fibers. This open type of filter allows generally free liquid flow and rapid passage of the beverage therethrough while filtering out the larger tea flakes and the larger coffee grounds. Ground tea, being generally of a large flake size will result in a standard tea brew, after passing through the filter lid embodiment, that is quite free of tea particulates. The coffee beverage produced can vary with regard to the amount of unfiltered particulates in relation to the fineness of the grind that is used with the filter lid. Typically, it is desirable to use a coffee grind size that is large enough so that after passing through the filter lid the filtered brew has the characteristic of coffee made by the "French press" method.

The importance of the filter lid is of great significance within the small office work place as such small offices cannot afford commercial beverage service providers. In the typical commercial beverage service contract, the user must have a sufficient office population the will consume a sufficient amount of coffee or tea so as to make installation of a $300 to $500 coffer brewing unit profitable. Small office populations do not use sufficient coffee or tea to make installation of such a brewing unit profitable. The filter lid embodiment, and in particular the self cleaning filter lid results in the ability of smaller office to avoid the high expense of the brewing units and to offer personnel the benefits of high quality beverage services as the only expense is the coffee and/or tea and the cups and lids.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A lid for closing a cup, the cup having a rim and being adapted and sized to hold a beverage including consumable fluid within an interior, the lid comprising:

a cup attachment portion for removable association with the rim of the drink cup in a snug, liquid-tight relation, an annular cover portion, a spout extending from said annular cover portion and unitarily formed with said annular cover portion, the spout having a lower end, an upper end, and opposed side walls between the lower end and the upper end defining an elongated interior space, the spout further having an opening disposed adjacent the upper end to provide passage of the beverage from the interior of the cup through the elongated interior space and the opening when the cup attachment portion is associated with the cup, and only a single filter, the filter being coupled to the lid, the filter being seated within and secured within and across said elongated interior space of the spout to filter the beverage as the beverage passes from the interior of the cup into and through the interior space and opening of the spout, the filter being a foam filter block extending from a lower portion of the spout towards the upper end of the spout and abutting at least a portion of the opposed side walls;

wherein, as the lid is repositioned into a vertical position, fluid within the spout adjacent the opening flows back through the filter to at least partially clean the filter, and wherein all fluid entering and leaving the spout flows through the filter.

2. The lid of claim 1 wherein the spout includes a shoulder projecting into the interior space, the filter being disposed adjacent the shoulder and between the shoulder and the interior.

3. The lid of claim 2 wherein the filter is secured to the spout by at least one of heat sealing or an adhesive.

4. The lid of claim 1 wherein the filter includes at least one of a generally open foam-like or open-cellular structure.

5. A lid for closing a cup, the cup having a rim and being adapted and sized to hold a beverage including consumable fluid within an interior, the lid comprising:

a cup attachment portion for removable association with the rim of the drink cup in a snug, liquid-tight relation, an annular cover portion, a spout extending from said annular cover portion and being unitarily molded with the annular cover portion, the spout having opposed side walls defining an elongated interior space, the opposed side walls including a shoulder projecting into the interior space, the spout further including an opening disposed to provide passage of the beverage from the interior of the cup through the elongated interior space and the opening when the lid is disposed on the cup, and only a single filter, the filter being coupled to the lid, the filter being subjacent the shoulder in and across the interior space, the filter being spaced from the opening to define a cavity between the filter, the opening, and a portion of the opposed walls, the filter being disposed to filter the beverage as the beverage passes from the interior of the cup into and through the interior space and opening of the spout.

6. The lid of claim 5 wherein the filter is secured to the spout by at least one of heat sealing or an adhesive.

7. The lid of claim 5 wherein the filter includes at least one of a generally open foam-like or open-cellular structure.

8. The lid of claim 5 wherein the filter includes at least one of plastic, paper, cellulose-based fibers, a mesh material, a porous material, or a disk with at least one of holes or slits.

9. The lid of claim 1 wherein the filter fills at least half of the interior space of the spout.

10. The lid of claim 1 wherein the filter extends from generally adjacent the lower end of the spout to at least a midpoint between the lower end and the upper end of the spout.

11. The lid of claim 1 wherein fluid disposed between an upper surface of the filter and the opening of the spout flows back through the filter to at least partially clean the filter when as the lid is repositioned into the vertical position.

12. The lid of claim 5 wherein, as the lid is repositioned into a vertical position, fluid within the spout adjacent the opening flows back through the filter to at least partially clean the filter, and wherein all fluid entering and leaving the spout flows through the filter.

13. A lid for closing a cup, the cup having a rim and being adapted and sized to hold a beverage including consumable fluid within an interior, the lid comprising:

a cup attachment portion for removable association with the rim of the drink cup in a snug, liquid-tight relation, an annular cover portion, a spout extending from the annular cover portion and including opposed sidewalls and an uppermost wall, the uppermost wall defining a spout opening and having an inside surface, the opposed sidewalls having inner surfaces with an upper end connected to the inside surface of the uppermost wall of the spout, and a lower end opening away from the spout opening, a distance between the inner surfaces of the sidewalls proximal the lower end being at least as great as a distance between the inner surfaces of the sidewalls at the upper end, and only a single filter, the filter being coupled to the lid, the filter being secured across the lower ends of the opposed sidewalls, wherein, as the lid is repositioned into a vertical position, fluid within the spout adjacent the opening flows back through the filter to at least partially clean the filter, and wherein all fluid entering and leaving the spout flows through the filter.

14. The lid of claim 13 wherein the distance between the inner surface of the sidewalls at the lower end is greater than the distance between the inner surface of the sidewalls at the upper end.

15. The lid of claim 13 wherein the spout includes a shoulder projecting into the interior space, the filter being disposed adjacent the shoulder and between the shoulder and the opening.

16. The lid of claim 13 wherein the filter is secured to the spout by at least one of heat sealing or an adhesive.

17. The lid of claim 13 wherein the filter includes at least one of a generally open foam-like or open-cellular structure.

18. The lid of claim 13 wherein the filter includes at least one of plastic, paper, or cellulose-based fibers.

19. The lid of claim 13 wherein the filter includes at least one of a mesh material, or a porous material.

20. A lid for closing a cup, the cup having a rim and being adapted and sized to hold a beverage including consumable fluid and ground coffee or tea leaves within an interior, the lid comprising:

a cup attachment portion for removable association with the rim of the drink cup in a snug, liquid-tight relation, an annular cover portion, a spout extending from the annular cover portion and including opposed sidewalls and an uppermost wall, the uppermost wall having an inside surface and defining a spout opening through the uppermost wall, the opposed sidewalls having inner surfaces with a upper end connected to the inside surface of the uppermost wall of the spout, and a lower end opening away from the spout opening, and only a single filter, the filter being coupled to the lid, the filter being secured across the opposed sidewalls, the filter being configured to filter the ground coffee or tea leaves from the beverage while permitting the consumable fluid to pass through the filter without substantially limiting flow of the consumable fluid;

wherein, as the lid is repositioned into a vertical position, fluid within the spout adjacent the opening flows back through the filter to at least partially clean the filter, and wherein all fluid entering and leaving the spout flows through the filter.

21. An assembly comprising:

a cup comprising a bottom, a side wall, and a rim along an upper surface of the side wall, the cup being adapted and sized to hold a beverage including a consumable fluid and ground coffee or tea leaves within an interior;

a material within the interior of the cup, the material comprising ground coffee or tea leaves; and the lid according to claim 1.

22. An assembly comprising:

a cup comprising a bottom, a side wall, and a rim along an upper surface of the side wall, the cup being adapted and sized to hold a beverage including a consumable fluid and ground coffee or tea leaves within an interior;

a material within the interior of the cup, the material comprising ground coffee or tea leaves; and the lid according to claim 5.

23. An assembly comprising:

a cup comprising a bottom, a side wall, and a rim along an upper surface of the side wall, the cup being adapted and sized to hold a beverage including a consumable fluid and ground coffee or tea leaves within an interior;

a material within the interior of the cup, the material comprising ground coffee or tea leaves; and the lid according to claim 13.

24. An assembly comprising:

a cup comprising a bottom, a side wall, and a rim along an upper surface of the side wall, the cup being adapted and sized to hold a beverage including a consumable fluid and ground coffee or tea leaves within an interior;

a material within the interior of the cup, the material comprising ground coffee or tea leaves; and the lid according to claim 20.

* * * * *